US005242321A

United States Patent [19]

Gil

[11] Patent Number: 5,242,321

[45] Date of Patent: Sep. 7, 1993

[54] FLIPPER-TYPE SWIMMING PROPULSION AIDS

[76] Inventor: Yoram Gil, 312 S. Westgate Ave., Los Angeles, Calif. 90049

[21] Appl. No.: 928,731

[22] Filed: Aug. 13, 1992

[51] Int. Cl.[5] ..... A63B 31/00

[52] U.S. Cl. ..... 441/64

[58] Field of Search ..... 441/61, 64, 55, 63, 441/75

[56] References Cited

U.S. PATENT DOCUMENTS

| | | | |
|---|---|---|---|
| 3,082,442 | 3/1963 | Cousteau et al. | 441/64 |
| 4,952,183 | 8/1990 | Gil | 441/61 |

FOREIGN PATENT DOCUMENTS

| | | | |
|---|---|---|---|
| 2455905 | 1/1981 | France | 441/64 |
| 351204 | 2/1961 | Switzerland | 441/64 |
| 1284765 | 8/1972 | United Kingdom | 441/64 |

*Primary Examiner*—Jesus D. Sotelo
*Assistant Examiner*—Stephen P. Avila
*Attorney, Agent, or Firm*—Philip D. Junkins

[57] ABSTRACT

A flipper-type swimming propulsion aid assembly for attachment to the feet of a swimmer to increase the swimmer's effective foot area. The swimming aid for each foot includes a collapsible frame of generally isosceles triangular configuration having side frame members of substantially equal length which are pivotally joined through a heel plate at the heel end of the frame and a foldable cross frame member joining the toe ends of the side frame members. The swimming aid also includes a fabric or plastic sheet web component which is placed over the collapsed frame assembly and thereafter the side frame members are separated with the cross frame member opened and extended. The web component is provided with mating attachment straps affixed to the toe end of said web component and positioned to be wrapped about the cross frame member to maintain such member's open and extended orientation. The side frame members have a relatively inflexible portion along the area of the frame and web component which is spanned by the swimmer's foot and a relatively flexible portion extending from the inflexible portion to the toe end of the side frame members whereby the flipper-type swimming propulsion aid assembly displays flutter flexibility in the extended effective fin area of the assembly and thereby added forward propelling force and action through leg flutter kick movements of the swimmer wearing the propulsion aid assembly on each foot.

12 Claims, 1 Drawing Sheet

FLIPPER-TYPE SWIMMING PROPULSION AIDS

The present invention, relating to flipper-type swimming propulsion aids, is an improvement on my prior invention, entitled "Collapsible Propulsion Aids for Swimmer's Feet," disclosed and claimed in my U.S. Pat. No. 4,952,183 granted on Aug. 28, 1990.

FIELD OF THE INVENTION

This invention relates to means to be used by a swimmer as an aid to propelling the swimmer through the water. More particularly, the invention relates to light-weight collapsible flipper-type fin means to be worn on the feet of an untrained or experienced swimmer to assist in propelling such swimmer through the water more rapidly over greater distances with reduced effort.

BACKGROUND OF THE INVENTION

For many years there has been a developing interest in swimming appliances and propulsion aids for swimmers including experienced swimmers who, more and more, engage in scuba diving. Particular attention has been given by swimmers to the design and development of foot wear for use in swimming. One approach to increasing the forward push or thrusting action obtainable from a swimmer's legs and feet has been the provision of swimming shoes. Swimming shoes of one general type have lateral wings that swing outwardly into the plane of the shoe's sole during alternating push or thrust strokes of the swimmers' legs and that swing toward each other and reside rearwardly of the boarders of the shoe sole during a forward or retracting portion of the swimmer's leg stroke so that little or no resisting surfaces of the wings are presented to the water during this movement of the swimmer's leg strokes. Examples of this form of swimming foot gear are disclosed in U.S. Pat. No. 1,043,770 granted to G. M. Larson, U.S. Pat. No. 1,506,885 granted to A. Cech and U.S. Pat. No. 1,626,541 granted to J. P. LaRosa.

Another approach to the provision of swimming shoe designs have been proposed in U.S. Pat. No. 1,626,175 granted to Zimmer and U.S. Pat. No. 1,983,609 granted to W. T. Hudson. In these patents lateral thrust wings are affixed in hinged manner to the shoe sole along the central longitudinal axis of the sole or to a central plate or platform along the central longitudinal axis thereof with the swimmer's foot strapped to such plate or platform. Again, these swimming aids are utilized where the swimmer utilizes a push or thrust type stroke of the legs followed by forward or retracting movement of the legs and such swimming aids are heavy, cumbersome and unwieldy and frequently come into interfering contact with one-another during the pushing portion of the leg strokes.

A still further design for foot gear for use in swimming has been proposed by P. J. Griffin in his U.S. Pat. No. 719,583 wherein lateral water thrust wings are hinged to a beam which is attached to and projects from an anklet ring worn on the swimmer's leg above each ankle. The beam on each of the swimmer's legs extends forwardly from the shin area above the ankle with the lateral wings moving outwardly above the forward portion and toes of each foot during leg thrust motion and inwardly and downwardly to the foot during the retracting portion of each leg stroke. The Griffin swimming gear requires that a strut extend from a metallic portion of a foot socket to the beam supporting the thrust wings to maintain such beam in its forwardly extending orientation from the swimmer's leg. As in the case of the previously described patented swimming aids, the Griffin gear is heavy, cumbersome and unwieldy with the inside thrust wings of each foot-borne structure often interfering with each other.

The inventor of the present invention has disclosed and claimed in his U.S. Pat. No. 4,884,986, granted Dec. 5, 1989, swimmer's propulsion aids which comprise substantial improvements over the aforementioned prior patents relating to swimmer's foot gear utilizing the action of lateral propulsion wings. The swimmer's propulsion aids of such patent include thrust wings and foot attachment means of light-weight construction and adaptability for rapid attachment of the propulsion aids to the swimmers foot.

Still further designs for swimmer's foot gear have been disclosed in U.S. Pat. No. 1,607,857 granted to F. Zukal and U.S. Pat. No. 2,672,629 granted to J. K. Latrell and comprise foot "flipper-type" swimmer's propulsion aids where the effective areas of the soles of the swimmer's feet are increased. With such gear, increased swimming propulsion force is derived during relatively normal flutter kicking action of the swimmer's legs and feet in an extended orientation without a reciprocating action of the legs. Collapsible forms of swim fin types of swimming propulsion aids have been disclosed in U.S. Pat. No. 4,250,584 granted to G. Korn and in French Pat. No. 2,675,927 granted to T. Rolland. U.S. Pat. No. 4,952,183 granted to the inventor of the present invention disclosed and claimed a significant improvement of flipper-type swimmer's propulsion aids over the Korn and Rolland patents.

It is an object of the present invention to provide flipper-type swimming propulsion aids for attachment to each foot of a swimmer with the aids being of light-weight construction, collapsible for convenient and compact storage, and having significant improved propulsion utility over the flipper-type aids of U.S. Pat. No. 4,952,183 by providing flutter flexibility in the extended effective fin area of the aids beyond the foot soles of the swimmer wearing the aids.

It is another object of the invention to provide light-weight flipper-type swimming aids designed for rapid and easy attachment to the feet of a swimmer and capable of assisting in propelling the swimmer through the water with a minimum of leg flutter-kick action.

Other objects and advantages of the invention will become apparent from the following summary and detailed description of a preferred embodiment of the invention taken in conjunction with the accompanying drawing figures.

SUMMARY OF THE INVENTION

The present invention relates to swimming propulsion aids of "flipper-type" for attachment to the feet of a swimmer with the aids or devices being of light-weight construction and capable of rapid assembly from pre-use compact stored or packaged components. The propulsion aids or the present invention are an improvement over the aids or devices of my prior U.S. Pat. No. 4,952,183 in that the improved flipper-type swimming aids have built-in flutter flexibility in the extended effective fin areas of the aids beyond the soles of the swimmer wearing the aids.

The assembled swimming aid for each foot is affixed to sole of the foot by foot and ankle straps and the aid substantially increased the foot area for assisting the forward propulsion of the swimmer through the water. The propulsion aids of the invention are particularly useful for a swimmer performing the well-known "American crawl" stroke which combines a hand-overhead arm stroke with a flutter kick of the legs and with the feet lashing upward and backward. The propulsion aids are also useful in performing the backstroke, much like the crawl turned upside down, with the swimmer using a flutter kick. It has recently been discovered that the flutter kick of the legs of the swimmer with the feet lashing action is more effective in propelling the swimmer if the flipper-type structure (or fin structure) of the propulsion aids of my prior invention have built-in flutter flexibility in the extended effective fin areas beyond the soles of the swimmer wearing the aids.

In accordance with the present invention the swimming aid structure or assembly for each foot of the swimmer is comprised of a strong fabric or flexible sheet plastic web component of generally triangular configuration applied to and supported on and by a collapsible frame. The frame is comprised of side frame members hinged together at their heel ends, extending in divergent manner from the heel of each foot forwardly along the sole and for a distance beyond the toes, and a cross frame member extending between the toe ends of the side frame members for maintaining the side frame members in their desired divergent orientation at the toe end of the assembly. The cross frame member is hinged in its middle portion so that the side frame members may be collapsed together.

The fabric or plastic web component of the swimming aid assembly is placed over the collapsed frame assembly and thereafter the side frame members are separated with the cross frame member opened and extended. The web component is provided with a flap portion at its toe end and such portion is positioned to surround and maintain the cross frame member in its extended orientation and thereby stretch the triangular web component over the assembled frame so that when the swimming propulsion aids are fixed to the swimmer's feet the effective propulsion area of the sole area of each foot is increased by at least double that of the sole area per se. The flap portion of the web is preferably maintained around the cross frame member by VELCRO brand interlocking hook and eye fastener means. The foot and ankle straps for affixing the swimming aid assemblies to the swimmer's feet are preferably comprised of strong non-stretchable fabric material with VELCRO brand fastener means.

In accordance with the improved flipper-type propulsion aids of the present invention there is built in flutter flexibility in the extended effective fin areas of the flipper-type structure, i.e., the fin areas beyond the soles of the swimmer wearing the aids. Thus, the hinged side frame members of the propulsion aid assemblies are each made semi-flexible in their extended portion beyond the point whereat the swimmer's sole and toes rest and are affixed to each assembly. Such semi-flexibility of the side frame members being in a direction generally perpendicular to the plane of the frame and web assembly forming each of the flipper-type propulsion assemblies.

BRIEF DESCRIPTION OF THE DRAWING FIGURES

Figure 2:
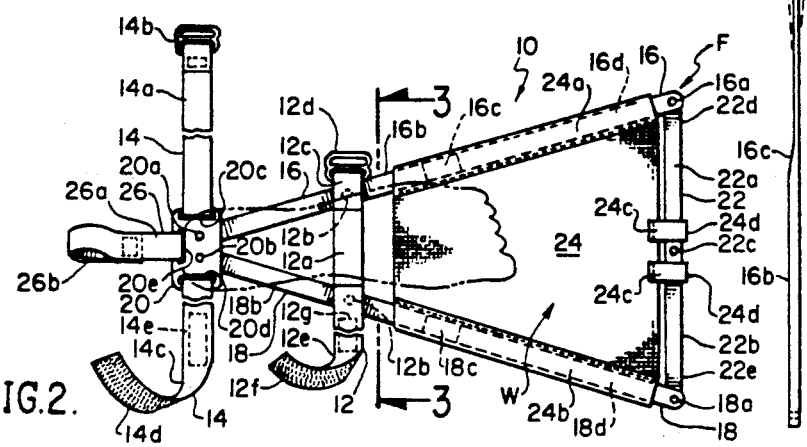
FIG. 2 is a top plan view of one of the flipper-type swimming propulsion aids of the invention in its assembled orientation with a swimmer's left foot shown in phantom outline in its position on the web component of the assembled aid ready for attachment of the swimming aid by the associated foot and ankle straps thereof.
Figure 6:
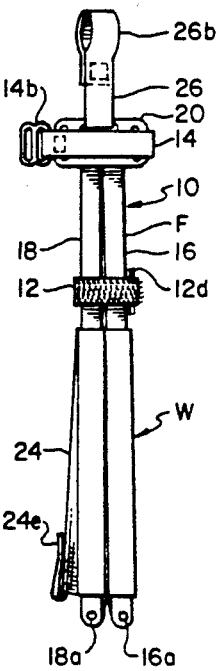

FIG. 6 is a top plan view of the swimming propulsion aid of FIG. 2 shown in collapsed form with the foot and ankle straps wound about the side frame members to maintain the swimming aid in its collapsed form for storage purposes; and FIGS. *7a, 7b* and *7c* are side elevation views of several representative form of the side frame members of the improved flipper-type swimming propulsion aids of the invention showing the structure of such frame members whereby flutter flexibility (illustrated by the dashed line flex positions of the side frame members) is built into such frame members and thus the extended effective fin area of the propulsion aids beyond the soles of the swimmer wearing the aids.

DETAILED DESCRIPTION OF THE PREFERRED EMBODIMENTS

Figure 1:
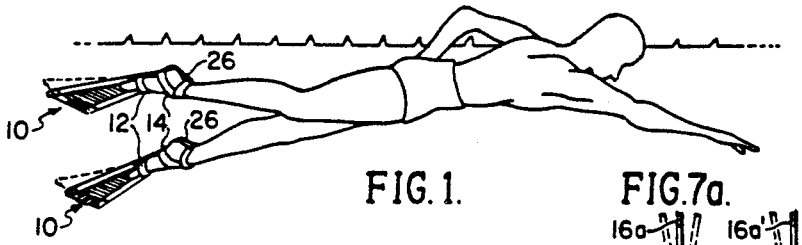
FIG. 1 is a side view showing a pair of the flipper-type swimming propulsion aids of the invention in use upon the feet of a swimmer with the built-in flutter flexibility feature of the flipper-type swimming aids shown in dashed outline.

Referring initially to FIG. 1 there is illustrated in a partial showing a swimmer utilizing a pair of the flipper-type swimming propulsion aids 10 of the invention mounted to the feet of the swimmer. As shown, the swimmer's legs are extended rearwardly in position to effect a flutter type kick of each leg for use in performing the "American crawl" swimming style with the feet and attached propulsion aids lashing upward and backward. Each of the swimming propulsion aids 10 is maintained on the swimmer's feet by a foot strap 12 and an ankle strap 14.

In FIG. 2 there is shown, in a top plan view, a swimming propulsion aid 10 of the invention with a swimmer's left foot shown in phantom outline in its position for attachment of the propulsion aid to the foot by a foot strap 12 and an ankle strap 14. The propulsion aid 10 is comprised of a collapsible triangular frame F and a web W of strong fabric material (or flexible sheet plastic material) supported on and by the frame. The collapsible triangular frame is comprised of: side frame members 16 and 18 (of substantially like configuration and of substantially equal length) which are pivotally joined to one-another at the heel end of the frame by a heel plate 20; and a cross frame member 22 which includes two components **22*a* and 22*b* which are foldably connected at a central pivot point 22*c*. The foldable cross frame member 22 is attached at its end portions 22*d* and 22*e* to the toe ends of side frame members 16 and 18 at pivot points 16***a* and 18*a*, respectively. The heel ends of side frame members 16 and 18 are pivotally affixed to heel plate 20 at pivot points 20*a* and 20*b*, respectively, of such plate.

Figure 3:
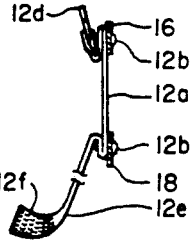
FIG. 3 is a cross-sectional view of the swimming propulsion aid of FIG. 2 taken on line 3—3 of FIG. 2 showing particularly the arrangement of the foot strap of the assembly with respect to the side frame members thereof.
Figure 4:
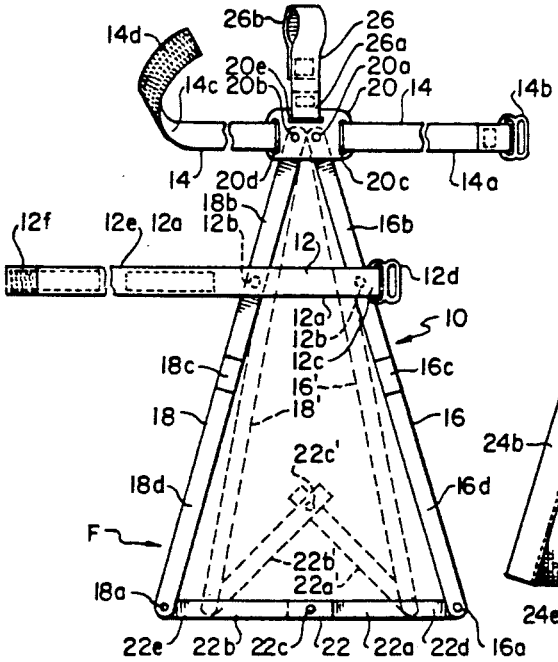
FIG. 4 is a top is a top plan view of one of the frame assemblies of the swimming propulsion aid of the invention with its associated foot and ankle straps, without the web component, and showing in dashed outline the manner in which the frame assemblies may be collapsed.

The foot and ankle straps 12 and 14, respectively, may be made of any suitable flexible (non-stretchable) strip of fabric material (such as canvas) or strip of sheet plastic material. The foot strap 12 has a mid-portion 12*a* which extends between, and is fastened to (as by rivets 12*b*), side frame members 16 and 18 (as shown in FIG. 3). One end portion 12*c* of the foot strap 12 is looped through a buckle 12*d* and then fastened by rivet 12*b* to its associated side frame member (member 16 as shown in FIGS. 2, 3 and 4). The other (extended length) end portion 12*e* of the foot strap 12 is provided with VELCRO brand hook and eye fastener means 12*f* and 12*g* which when such portion is passed through buckle 12*d*, mate to adjustably maintain strap end portion 12*e* over the foot of a swimmer wearing the swimming propulsion aid 10 to assist in maintaining such aid on the swimmer's foot. The ankle strap 14 is provided at one of its ends 14*a* with a buckle 14*b*. The other (extended length) end portion 14*c* of such strap is provided with VELCRO fastener means 14*d* and 14*e* which, when such end portion is passed through buckle 14*b*, mate to adjustably maintain strap 14 in position about the ankle of the a swimmer wearing the swimming propulsion aid 10. The ankle strap 14 is held in place under the heel plate 20 by extending such strap through slots 20*c* and 20*d* in the heel plate as shown in FIGS. 2 and 4.

The heel plate 20 also includes a strap slot 20*e* (see FIGS. 2 and 4) to which a short heel strap 26 is affixed at one of its ends 26*a*. The free end 26*b* of the heel strap 26 takes the form of a strap loop through which the ends of ankle strap 14 pass in their wrapping course about the swimmer's ankle as described hereinafter.

Figure 5:
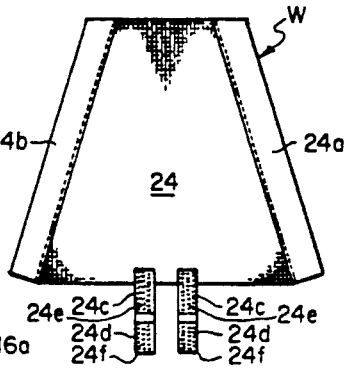
FIG. 5 is a top plan view of the fabric or sheet plastic web component of the flipper-type swimming propulsion aid of FIG. 2 prior to its assembly to the collapsed frame of the propulsion aid.

The web W of fabric material (or flexible sheet plastic material) 24 forming the increased flipper area of the swimming propulsion aid 10 of the invention is maintained on the triangular frame F of the propulsion aid by elongated side fabric loops 24*a* and 24*b* which encompass, respectively, side frame members 16 and 18. The toe end of the web fabric material 24 extends across the frame proximate cross frame member 22 and includes (as particularly shown in FIG. 5) two pairs of mating web attachment straps 24*c* and 24*d* which are positioned to be wrapped about the cross frame member 22 to maintain such frame member in its fully extended form and thereby force the side frame members 16 and 18 outwardly from one-another as described hereinafter. The pairs of attachment straps 24*c* and 24*d* bear VELCRO hook and eye fastener means 24*e* and 24*f*, respectively, for maintaining such straps in their intended surrounding position about cross frame member 22.

In FIG. 4 a frame assembly of one of the swimming propulsion aids of the invention is shown without the web component W. In solid line presentation the side frame members 16 and 18 of the triangular frame F are spread to their position of wide angular orientation with the foldable cross frame member 22 extended to its full length. In the broken line presentation the side frame members 16' and 18' of frame F are partially collapsed with the components 22*a'* and 22*b'* of the cross frame member 22 partially folded about their connecting pivot point 22*c'*. With the web component W (of FIG. 5) in place on the triangular frame F of the swimming propulsion aid 10 and with the web's pair of attachment straps 24*c* and 24*d* free of their surrounding embracement of cross frame member 22, the frame F and web W may be completely collapsed as shown in FIG. 6. In such collapsed form the web W folds between the side frame members 16 and 18 and the foot strap 12 and ankle strap 14 may be wound about the side frame members 16 and 18 whereby the swimming propulsion aid takes its compact storage form.

Figure 7A:
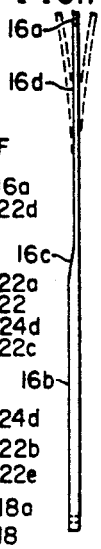

The side frame embers 16 and 18 and the components 22*a* and 22*b* of the cross frame member 22 of the swimming propulsion aid of the present invention are preferably made of relatively thin metallic strips (aluminum), fiber glass reinforced plastic strips or other strong molded plastic strips with the resulting structure of the propulsion aid (including the straps and web member) being of relatively light weight. As previously indicated, the improved flipper-type swimming propulsion aids of the present invention include built in flutter flexibility in the extended effective fin areas of the flipper-type structure, i.e., the fin areas beyond the soles of the swimmer wearing the propulsion aids. To achieve the desired flutter flexibility in such fin areas the side frame members 16 and 18 of the collapsible frame F (as shown in FIGS. 2, 4 and 7*a*) are comprised of metallic, fiber glass reinforced plastic or molded plastic strips which include a relatively stiff or inflexible portion 16*b* and 18*b*, respectively, over the length of such side frame members along the area of the frame (and web component) which is spanned by the swimmer's foot. Beyond the stiff portions of the side frame members, and to the toe ends thereof, such frame members each have a relatively thin flexible portion 16*d* and 18*d*, respectively. The relatively inflexible portion of each side frame member may be separated from the thin flexible portion thereof by a transition portion 16*c* and 18*c*, respectively.

Figure 7B:
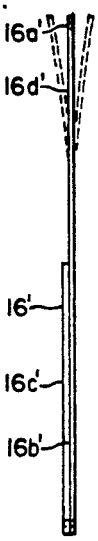
Figure 7C:
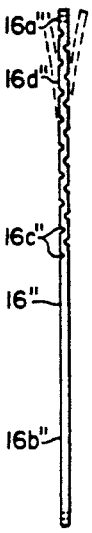

In FIG. 7*a* there is presented a side elevation view of the side frame member 16 of the frame F of the swimming propulsion aid of FIGS. 2 and 4 showing the relatively stiff or inflexible portion 16*b*, a material thickness transition portion 16*c* and relatively thin flexible portion 16*d*. An alternative form of a plastic side frame member is shown in the side elevation view FIG. 7*b* wherein side frame member 16' includes a portion 16*b'* which is reinforced by a plastic strip 16*c'* to substantially reduce the flexibility of the frame member in the reinforced area. The reinforcing strip 16*c'* may be affixed to the frame member 16' by an adhesive or other known means. The portion 16*d'* of the frame member is not reinforced and displays the desired flutter flexibility for the fin area of propulsion aid beyond the sole of the swimmer's foot. A further alternative form of a plastic or metallic side frame member is shown in the side elevation view FIG. 7*c* wherein the side frame member 16'' includes a portion 16*b''* which is relatively inflexible and a portion 16*d''* which includes a series of spaced notches 16*c''* on one or both sides thereof to build in desired flutter flexibility in portion 16*d''* of the side frame member. The flutter flexibility feature of the side frame members of the swimming propulsion aids of the present invention is further illustrated in FIGS. 7*a*, 7*b* and 7*c* by the dashed line showing of the flexed position of the flexible portion of each form of a side frame member.

The foregoing described embodiments (with alternative structural features) of the flipper-type swimming propulsion aids of the invention are easily assembled. The propulsion aid or swim flipper of FIGS. 2–6 has its web component W mounted to side frame members 16 an 18 via the web's side loops 24*a* and 24*b* and thereafter the toe ends of such frame members are affixed to the foldable cross frame members 22 as pivot points 16*a* and 18*a*, respectively. The pairs of mating web attachment straps 24*c* and 24*d* are wrapped about the cross frame member 22 to maintain such frame member in its fully extended form and thereby force the side frame members 16 and 18 outwardly from one-another.

To mount the flipper-type swimming propulsion aid of the invention to a swimmer's foot, the swimmer's foot is positioned on one of the propulsion aids as shown in FIG. 2 with the swimmer's heel resting on the heel plate 20, the swimmer's foot arch spanning the mid portion 12*a* of the foot strap 12, and with the ball portion of the swimmer's foot resting on the heel end of the web W. The extended length end 12*e* of the foot strap 12 is thereafter affixed around and across the top of the foot with the end thereof looped through the buckle 12*d* with the VELCRO fastener means joined to maintain the foot strap in position to hold the swimming propulsion aid to the swimmer's foot. The ankle strap 14, which passes through slits 20*c* and 20*d* in the heel plate 20 as shown in FIGS. 2 and 4, has its ends 14*a* and 14*c* drawn forwardly across each other in front of the swimmer's ankle and thence around the leg, through the loop 26*b* of heel strap 26, and thence forwardly around the leg with the terminal end 14*c* (bearing VELCRO fastener means 14*d* and 14*e*) looped through buckle 14*b* with the fastener means 14*d* and 14*e* mated to secure the rear portion of the swimming propulsion aid to the swimmer's foot.

With the flipper-type swimming propulsion aids of the invention mounted to a swimmer's feet, the swimmer is assisted in propelling himself or herself through the water with a minimum of leg flutter kick action because of the substantial increase in effective foot area of the swimmer. Further, because of the built in flutter flexibility in the extended effective fin area of the flipper-type structure in accordance with the present invention, the swimmer derives added forward propelling force and action through the leg flutter kick movements which more nearly duplicates the strong flutter movement of the tail fins of fish. During the swimmer's leg flutter kick movements the flexible fin area of the flipper-type structure of the invention moves in sine wave fashion.

The present invention relating to the incorporation of flutter flexibility in the extended effective fin area of flipper-type swimming propulsion aids is also applicable to, and comprises an improvement on, my prior invention entitled "Propulsion Aids for Attachment to a Swimmer's Feet," disclosed and claimed in my U.S. Pat. No. 4,907,519 granted on Mar. 13, 1990. The disclosures, drawing figures and teachings in such patent are made a part of the disclosure herein by reference thereto.

While the present invention has been described with reference to preferred embodiments thereof, it is obvious that modifications and alterations of such embodiments will occur to others skilled in the art upon their reading and understanding of this specification. It is therefore to be understood that the present invention includes all such modifications and alterations, and equivalents thereof, being limited only by the scope of the following claims.

What I claim is:

1. In a flipper swimming propulsion aid assembly for attachment to each foot of a swimmer to increase the swimmer's effective foot area during flutter kick swimming procedures:

(a) a collapsible frame comprised of elongated side frame members of substantially equal length adapted for pivotal joinder at the heel end of said frame and a cross frame member affixed at its ends to the toe ends of the side frame members with the result that in its operative form said frame is of generally isosceles triangular configuration;

(b) a web component for said frame comprised of a flexible material selected from the group consisting of fabric and sheet plastic materials, said web components being of a configuration matching the operative form and size of said frame from its toe end to at least the mid-point of the side frame members, said web component including side means for receiving and maintaining the side frame members and including means at its toe end for maintaining said web stretched over the toe ends of said side frame members and for maintaining said cross frame member across the toe end of said frame;

(c) means associated with the side frame members and cooperating to maintain said swimming aid assembly affixed to the forward portion of the swimmer's foot; and (d) means associated with the heel end of said frame to affix said swimming aid assembly to the heel portion of the swimmer's foot, the improvement in said assembly to increase the propulsion effectiveness thereof during said flutter kick swimming procedures comprising:

the provision of side frame members for said collapsible frame each having a relatively inflexible portion along the area of said frame and said web component which is spanned by the swimmer's foot and a relatively flexible portion extending from said inflexible portion to the toe end of said side frame members whereby said flipper swimming propulsion aid assembly displays flutter flexibility in the extended effective fin area of said assembly in each opposite direction perpendicular to the plane of said frame and thereby added forward propelling force and action through let flutter kick movements of the swimmer wearing said assembly on each foot.

2. In a flipper swimming propulsion aid assembly for attachment to each foot of a swimmer as claimed in claim 1 wherein the cross frame member of said frame is relatively inflexible.

3. In a flipper swimming propulsion aid assembly for attachment to each foot of a swimmer as claimed in claim 1 wherein the means associated with the side frame members and cooperating to maintain said swimming aid assembly affixed to the forward portion of the swimmer's foot comprises a foot strap affixed to the side frame members and the means associated with the heel end of said frame to affix said swimming aid assembly to the heel portion of the swimmer's foot comprises ankle straps affixed to the heel end of said frame.

4. In a flipper swimming propulsion aid assembly for attachment to each foot of a swimmer to increase the swimmer's effective foot area during flutter kick swimming procedures:

(a) a collapsible frame comprised of elongated side frame members of substantially equal length adapted for pivotal joinder to a heel plate at the heel end of said frame and a foldable cross frame member pivotally joined at its ends to the toe ends of the side frame members with the result that in its operative form said frame is of generally isosceles triangular configuration:

(b) a web component for said frame comprised of a flexible material selected from the group consisting of fabric and sheet plastic materials, said web components being of a configuration matching the operative form and size of said frame from its toe end to at least the mid-point of the side frame members, said web component including side means for receiving and maintaining the side frame members and including means at its toe end for maintaining said web stretched over the toe ends of said side frame members and for maintaining said foldable cross frame member in its fully extended orientation across the toe end of the frame;

(c) a foot strap affixed to the side frame members to affix said swimming aid assembly to the forward portion of the swimmer's foot; and (d) ankle straps each affixed to the heel plate of said frame to affix said swimming aid assembly to the heel portion of the swimmer's foot, the improvement in said assembly to increase the propulsion effectiveness thereof during said flutter kick swimming procedures comprising:

the provision of side frame members for said collapsible frame each having a relatively inflexible portion along the area of said frame and said web component which is spanned by the swimmer's foot and a relatively flexible portion extending from said inflexible portion to the toe end of said side frame members whereby said flipper swimming propulsion aid assembly displays flutter flexibility in the extended effective fin area of said assembly in each opposite direction perpendicular to the plane of said frame and thereby added forward propelling force and action through leg flutter kick movements of the swimmer wearing said assembly on each foot.

5. In a flipper swimming propulsion aid assembly for attachment to each foot of a swimmer as claimed in claim 4 wherein the web components of said swimming aid assembly is comprised of a single layer of a flexible material and the side means thereof for receiving and maintaining the side frame members comprises side loops of said material which encompass said side frame members.

6. In a flipper swimming propulsion aid assembly for attachment to each foot of a swimmer as claimed in claim 4 wherein the web component of said swimming aid assembly is comprised of a double layer of a flexible material and the side means thereof for receiving and maintaining the side frame members comprises side seams of the double layer web component along the side frame members of said frame.

7. In a flipper swimming propulsion aid assembly for attachment to each foot of a swimmer as claimed in claim 4 wherein a heel strap is affixed to the heel plate, said heel strap in its free end taking the form of a strap loop through which said ankle straps may pass when utilized to affix said swimming aid assembly to the heel portion of the swimmer's foot.

8. In a flipper swimming propulsion aid assembly for attachment to each foot of a swimmer as claimed in claim 4 wherein the foot strap includes a first end portion having a buckle loop and a second end portion having hook and eye fastener means which are positioned to connectively mate upon insertion of said second end portion through said buckle loop.

9. In a flipper swimming propulsion aid assembly for attachment to each foot of a swimmer as claimed in claim 4 wherein one ankle strap in its end portion includes a buckle loop and the other ankle strap in its end portion includes hook and eye fastener means which are position to connectively mate upon insertion of said other ankle strap through said buckle loop.

10. In a flipper swimming propulsion aid assembly for attachment to each foot of a swimmer as claimed in claim 4 wherein the means at the toe end of said web component for maintaining said foldable cross frame member in its fully extended orientation across the toe end of the collapsible frame of said swimming aid assembly comprises mating attachment straps affixed to the toe end of said web component and positioned to be wrapped about the cross frame member, said straps bearing hook and eye fastener means for maintaining said straps in their wrapped position about said cross frame member.

11. In a flipper swimming propulsion aid assembly for attachment to each foot of a swimmer as claimed in claim 4 wherein the side frame members are formed of a material selected from the group consisting of light weight metals, fiberglass reinforced plastics, laminated plastics and molded plastics and the relatively inflexible portion of said side frame members is of a thickness whereby said portion is substantially inflexible to the force of flutter kick movements of the swimmer wearing said assembly and said relatively flexible portion of said side frame members is of lesser thickness whereby said portion is flexible to the force of said flutter kick movements.

12. In a flipper swimming propulsion aid assembly for attachment to each foot of a swimmer as claimed in claim 4 wherein the side frame members are formed of a material selected from the group consisting of light weight metals, fiberglass reinforced plastics, laminated plastics and molded plastics and the relatively inflexible portion of said side frame members is of a thickness whereby said portion is substantially inflexible to the force of flutter kick movements of the swimmer wearing said assembly and said relatively flexible portion of said side frame members includes a series of cross grooves whereby said portion is flexible to the force of said flutter kick movements.

* * * * *